United States Patent [19]

Root

[11] 3,941,179

[45] Mar. 2, 1976

[54] DAMPER CONSTRUCTION AND SPRING

[75] Inventor: James R. Root, Independence, Mo.

[73] Assignee: Ruskin Manufacturing Company, Grandview, Mo.

[22] Filed: Feb. 24, 1975

[21] Appl. No.: 552,440

[52] U.S. Cl. ..... 160/84 R; 160/1; 160/235

[51] Int. Cl.[2] ..... E06B 3/48; E05F 1/12

[58] Field of Search ..... 160/84, 1, 9, 199, 206, 160/207, 213, 229 R, 235; 16/184, 180

[56] References Cited

UNITED STATES PATENTS

| | | | |
|---|---|---|---|
| 3,273,632 | 9/1966 | McCabe | 160/1 |
| 3,525,378 | 8/1970 | Root | 160/1 |
| 3,832,756 | 9/1974 | Lew | 16/184 X |

*Primary Examiner*—Philip C. Kannan

*Attorney, Agent, or Firm*—Fishburn, Gold & Litman

[57] ABSTRACT

A folding blade damper comprising a rectangular frame and an assembly of blades hingedly interconnected along longitudinal marginal edges by tubular hinge elements. A spring is interposed between each interconnected pair of blades to resiliently urge the blades from a folded to an unfolded flow blocking position across the frame. The spring comprises a flat member having an arcuate portion generally coaxially of the tubular hinge elements and oppositely extending arms in overlying engagement with adjacent blades with fingers extending over an edge of a respective blade to engage the opposite face thereof and cooperate with the arms to resiliently and removably secure the spring to said blades whereby the arcuate portion is contracted upon folding of said pair of blades and then exerts a torque urging the connected blades to unfolded position.

9 Claims, 5 Drawing Figures

Fig. 2.
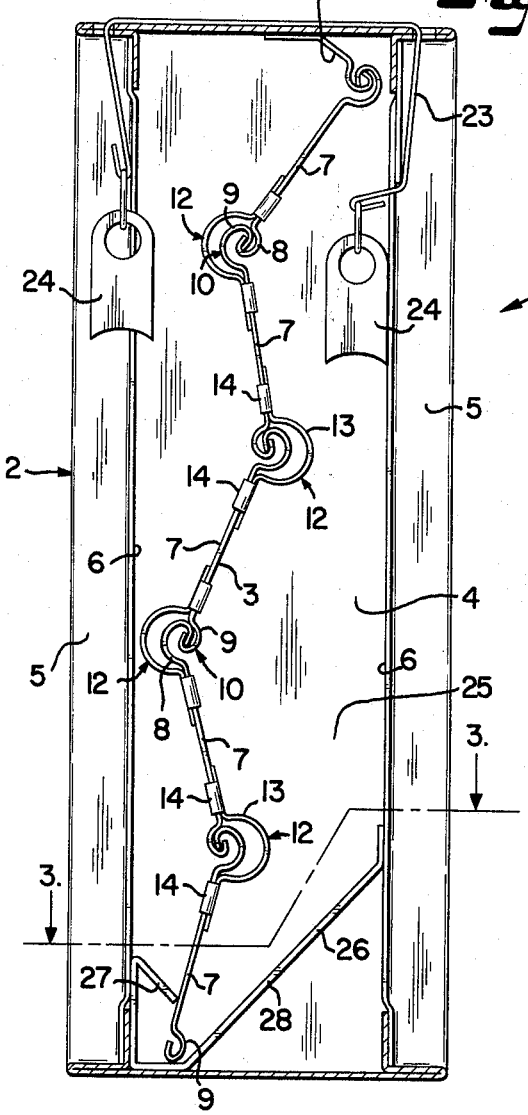
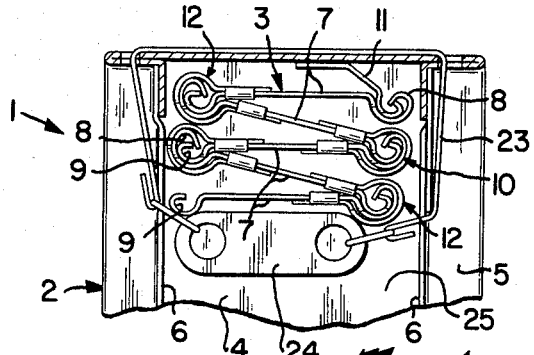
Fig 1.
Fig. 3.
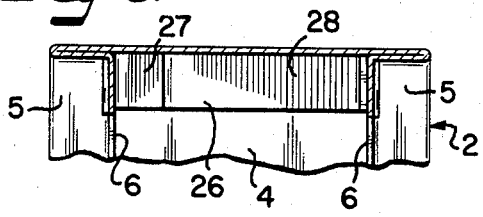
Fig. 5.
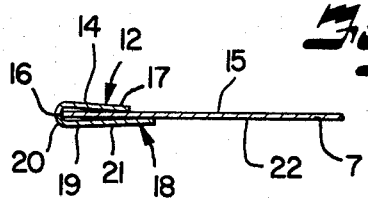
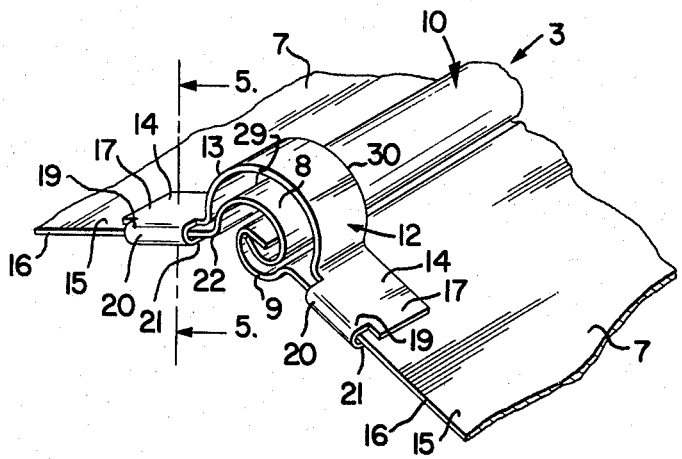
Fig. 4.

DAMPER CONSTRUCTION AND SPRING

This invention relates to closures, and more particularly to a folding blade closure such as a fire damper or the like.

Closures of this type conventionally comprise an assembly of hingedly interconnected blades which are normally disposed in a folded, standby position adjacent one side of a rigid, rectangular, peripherally extending frame. The unit may be interposed in an air duct or the like for closing the duct in the event of a fire. In such case, the folded assembly is conventionally held in such standby position by a destructible device which may include a temperature fusible link. When the heat melts the link, the assembly is expected to automatically move to its flow blocking position.

When the frame can be mounted vertically across a generally horizontally extending duct or passage, gravity may often be relied upon for unfolding the blades of the assembly. When, however, the unit must be installed in a horizontal position as is necessary for protecting a vertical shaft, auxiliary springs are necessary for motivating the blade assembly across the frame opening upon destruction of the temperature sensitive device.

Dampers of this type are installed as safety precautionary measures, and must be capable of reliable performance even after long periods of inactivity. Heretofore, tension springs have been attached to the end blade of the assembly for pulling the closure across the frame upon melting of the fusible link, but such springs may become fouled or otherwise become ineffective after long periods of inactivity. Torsion springs having elongate portions extending into the tubular hinge element, as illustrated in the Root U.S. Pat. No. 3,525,378, issued Aug. 25, 1970, provided a more reliable damper structure than those using the tension spring. The present invention is an improvement on the structure of U.S. Pat. No. 3,525,378 to provide a structure more economical to manufacture with even higher degree of reliability.

The principal objects of the present invention are: to provide a closure unit having novel springs carried by the blades of the closure and operative when called upon to move the blades to the flow blocking position without any interference with the operation; to provide such a closure unit wherein the springs are on the outside of the blades and out of the path of any part of the blades; to provide such a structure wherein the springs are formed from flat material, economically manufactured and easily installed and replaced in the damper assemblies; to provide such a structure in which the blade operating springs occupy a minimum of space in the assembled unit and to not interfere with or vibrate as a result of flow of fluid through the open unit; to provide such a structure with springs which are made from commercially available materials and relatively invulnerable to corrosion and retain their effectiveness during the relatively long periods of standby service; to provide such a spring structure which may be readily installed on any of a number of conventional fire damper units having a wide variety of blade configurations; and to provide such a closure structure and springs which is ecomonical to manufacture, efficient in use and capable of long operating life and particularly well adapted for the proposed use.

Other objects and advantages of this invention will become apparent from the following description taken in connection with the accompanying drawings wherein are set forth, by way of illustration and example, certain embodiments of this invention.

The drawings constitute a part of this specification and include exemplary embodiments of the present invention and illustrate various objects and features of the apparatus.

FIG. 1 is a fragmentary, vertical cross-sectional view through a fire damper illustrating the blade assembly in elevation and in its standby position.

FIG. 2 is a view similar to FIG. 1, but showing the blade assembly in its closed position.

FIG. 3 is a fragmentary, horizontal cross-sectional view taken along the line 3—3 of FIG. 2.

FIG. 4 is a fragmentary perspective view of a pair of interconnected blades and showing a spring installed thereon.

FIG. 5 is a sectional view through a spring and blade taken on the line 5—5, FIG. 4.

Referring more in detail to the drawings:

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring initially to FIGS. 1, 2 and 3, the illustrated structure has a closure 1 in the nature of a fire damper having a frame 2 and blade assembly 3 which are substantially of the structure illustrated in U.S. Pat. No. 3,525,378. The closure 1 is provided with a generally rectangular peripherally extending frame 2 which is constructed from an initially flat band 4 of material such as sheet metal. The outermost marginal edge of the band 4 is bent back upon itself to present a rim 5 for the frame 2. The end portion 6 of the edge margin of the band 4 is then bent inwardly normal to the main plane of the band 4 to present an integral stiffening rib for the frame.

The blade assembly 3 comprises a plurality of identical blades 7 mounted within the frame 2. Each blade 7 is provided with a relatively large generally tubular hinge element 8 on one marginal edge thereof and a somewhat smaller, generally tubular hinge element 9 on the opposite marginal edge thereof. The hinge element 9 of one blade 7 is partially telescoped within the hinge element 8 of the next adjacent blade 7 to provide a tubular hinge 10 between each pair of adjacent blades 7 of the assembly 3. Mounting means in the nature of a blade 11 having its hinge element 8 removed, is rigidly secured along one side of the frame 2 and extends downwardly at an angle as illustrated in FIGS. 1 and 2. The hinge element 8 of the uppermost blade 7 of assembly 3 is hingedly secured to blade 11 to permit articulation of each of the blades 7 as will be hereinafter described.

Referring to FIG. 1, it may be seen that the longitudinally extending blades 7 may be reversely folded upon one another to positions generally as illustrated in FIG. 1 wherein the assembly 3 is compactly positioned adjacent one side of the frame 2. Manifestly, relatively uninhibited flow of fluid is thereby permitted through frame 2. It is contemplated that frame 2 will be installed in a duct or ventilation shaft or the like.

Referring to FIGS. 4 and 5 in conjunction with FIGS. 1, 2 and 3, the spring 12 is provided between the respective blades 7 for urging the blades from the folded position thereof as illustrated in FIG. 1 to the unfolded position as illustrated in FIG. 2. Each spring 12 may be constructed from an initially flat strip or sheet of suitable spring material, such as stainless steel, that is cut and bent to present an arcuate central portion 13 terminating at its ends in opposed arm structures 14 adapted to engage surfaces 15 adjacent end edges 16 of the respective blades 7 interconnected by the hinge 10.

The arm structures 14 each include elongate portions 17 that are substantially flat or otherwise adapted to engage a stretch of the blade surface 15 extending from the hinge 10 of respective connected blades 7. Each arm structure 14 is provided with fastening means 18 to secure the arm structure to the respective blades 7. In the illustrated structure, each elongate portion 17 has a laterally extending member 19 provided with a reverse bend 20 to form a finger 21 that is biased toward the elongate portion 17 to cooperate therewith in gripping the blade 7. It is noted that the arcuate central portion 13 is generally coaxially of the respective tubular hinge 10 with the elongate portions 17 of the respective arm structure engaging blade surfaces 15 adjacent the respective hinge and also adjacent the blade end edges 16 whereby the laterally extending member 19 and the bend therein extend over the edge with the finger 21 engaging the blade surfaces 22 which in the illustrated structure are the adjacent surfaces of respective hingedly connected blades when the blades are in folded position. This arrangement positions the arcuate central portion 13 and flat portions 17 of the spring on the outside of the folded blades. The structure provides for the spring 12 to be arranged at the ends of the hingedly connected blades and the spring then to be moved longitudinally of the hinge to move the spring onto the blades with the elongate portions 17 and fingers 21 engaging the blade surfaces 15 and 22 respectively with a resilient gripping action to removably secure the spring relative to the respective blades. It is preferred that in the manufacture of the spring, the opposed elongate portions extend from the ends of the arcuate portions 13 in a substantially coplanar relation so that when mounted in the damper structure, the portions 17 of each spring 12 extend in opposite directions and serve to bias the respective blades of a hinged together pair thereof into the unfolded position as illustrated in FIG. 2.

The blade assembly 3 provided with the springs 12 at the respective hinge connections 10 may be held in the folded position by a conventional temperature sensitive device such as a circumscribing band 23 having a temperature fusible link 24 interposed therein. It is contemplated that a spring 12 will be provided for each end of each hinge joint 10 to balance the forces tending to swing the blade to the unfolded position and to avoid any possibility of binding. It will be obvious, however, to those skilled in the art that it is not absolutely necessary that each of the hinge joints be provided with a spring 12. Rather, only sufficient hinge joints may be provided with springs as is necessary to impart a thrust to the blade capable of shifting the same to the unfolded position. When the fire damper is to be installed in a horizontal position, more spring energy will be required for closing the blade assembly than is necessary when the damper is installed in a vertical position wherein gravity may be relied upon for moving the blades.

The springs 12 and the mounting thereof on the respective blades are such that elongate portions 17 are substantially rigid members at the end of the arcuate portion and the folding of the blade to the position shown in FIG. 1 provides a winding action contracting the arcuate portion and storing energy that is delivered as torque returning the blades to the unfolded position when they are released. The springs are formed of material having suitable thickness and of a width to provide the necessary torque to unfold the blades.

The folding of the blades, as illustrated in FIG. 1, results in contracting of the arcuate central portion 13 to a position generally as illustrated in FIG. 1. This bending stores energy in the spring which is released upon the separation of the link 24 and the springs immediately unfold the respective blades whereby the closure panel provided by the articulated blade assembly 3 springs across the opening within the confines of the frame 2. The inwardly projecting portions or ribs 6 on each side of the frame 2 provide a channel 25 therebetween to guide the blades in the unfolding movement. A bracket 26 secured on a pair of sides of the frame 2 adjacent the ends thereof remote from the blade 11 includes an upwardly extending hook portion 27 and a downwardly inclined ramp portion 28 angled in the direction of the hook portion 27.

The lower most hinge element 9 of the end blade 7 contacts the ramp 28 and the hinge element 9 sides along the ramp to the position illustrated in FIG. 2. This position brings proximal face of the end blade 7 in engagement with the hook portion 27 and prevents opening of the closure provided by the unfolded assembly 3. The proximal spring 12 has a tendency to bias a lowermost blade 7 into a angled position with respect to the next adjacent blade 7 rather than to a position where the blades are aligned so that any upward movement of the lower blade 7 will cause the hinge element 9 thereof to engage the hook portion 27.

In the structure illustrated, the springs 12 have edges 29 adapted to be positioned adjacent the end edges 16 of the blade with opposed edges 30 spaced therefrom. The ends of the finger 21 extend beyond the spring edges 30 with the fingers normally inclined from the bend 20 toward the edge 30 of the elongate portion 17 whereby the elongate portion and finger end must be spread to apply same to the blade, biasing the finger toward the elongate portion and forming a resilient gripping of the blade to hold the springs thereon. The arrangement of the springs is such that the arcuate central portion partially encircles the tubular hinge and is on the outside of the connected blades unfolded thereby being out of the path of any part of the damper blades when moving from a folded to an unfolded position.

The engagement of the elongate arm portion and the fingers with the connected blades is adjacent end edges of said blades and the end edges are engaged by the reversed bend 20 of the member 19 so the mounting of the spring on the respective blade tends to hold the blades in proper alignment by preventing relative movement of one blade longitudinally of the other.

In use, the damper structure and arrangement of the springs relative to the blades, the springs are easily installed and replaced, if necessary, as they are put on from the end with no portion thereof in the connecting portions of the damper blade.

It is to be understood that while I have illustrated and described certain forms of my invention, it is not to be limited to the specific forms or arrangement of parts herein described and shown.

What I claim and desire to secure by Letters Patent is:

1. In a closure comprising a plurality of elongated blades, each blade being hingedly connected along a marginal edge to the adjacent blade for swinging movement between a folded position lying generally along said adjacent blade, to an unfolded position disposed generally in extension of said adjacent blade, spring means for urging a pair of said blades into said unfolded position, said spring means comprising:

a. a spring member having an arcuate central portion with arm structures extending therefrom, each arm structure being generally flat and extending normally in the opposite direction from the other arm structure with the arcuate portion being generally coaxial of a hinge connection of said pair of blades and spaced outwardly thereof and each arm structure being in overlying engagement with outer side surfaces of its corresponding blade of its pair and having means removably and frictionally engaging said corresponding blade in radially spaced relation from an axis of swinging movement between said pair of blades for securing the respective arm to said corresponding blade;

b. said arcuate central portion being a torsion element whereby contracting thereof upon folding of said pair of blades biases said arm structures in directions to return said blades to said unfolded position.

2. Apparatus as set forth in claim 1 wherein:

a. each arm structure has a U-shaped portion extending over an end edge of a respective blade and resiliently gripping opposed surface portions thereof to secure the spring member thereto.

3. Apparatus as set forth in claim 2 wherein:

a. a said spring member is provided for each end of the hinge connection for a pair of blades.

4. Apparatus as set forth in claim 1 wherein:

a. said blades are interconnected by a tubular hinge;

b. said spring member is a flat spring with said arcuate central portion being curved on a radius larger than the tubular hinge and positioned exteriorly thereof.

5. Apparatus as set forth in claim 4 wherein:

a. said blades have opposed side surfaces;

b. each arm structure has a portion engaging a corresponding blade on a side surface thereof that is outwardly when the blades are in folded position;

c. each arm structure is provided with a finger extending therefrom over an end edge of the blade and engages the other side surface of the blade, said finger and arm cooperating to grip the blade therebetween to secure the spring member thereto.

6. Apparatus as set forth in claim 5 wherein:

a. each arm and finger thereof forms a U-shaped structure with a bight thereof engaging an end edge of the respective blade and retaining the blades of said pair against relative longitudinal movement.

7. A closure comprising, in combination:

a. a rigid rectangular frame including spaced apart frame side members;

b. a plurality of elongated blades, said blades extending between the side members with each side member disposed adjacent the corresponding ends of the blades;

c. tubular hinge means carried by adjacent marginal edges of said blades for interconnecting each blade with an adjacent blade for folding of said interconnected pair of blades along the axes of said hinge means;

d. torsion spring means for each hinge means respectively, each spring means including a flat member with a central portion bent in an arcuate curve extending over a portion of said tubular hinge means to present elongated arms extending from the central portion, each normally in the opposite direction from the other arm, said arms being generally flat and in overlying engagement with outer side surfaces of a pair of blades and adjacent an end edge of the respective blades;

e. fingers on said arms and extending laterally therefrom over an adjacent end edge of the respective blade and under said blade for engaging under side surfaces thereof and cooperating with the arm to grip the respective blade therebetween and removably secure the spring member to said pair of blades, said spring means being adapted to be applied to engaging the arms and fingers thereon with end edges of said pair of blades adjacent the respective hinge means and sliding same on to the blades;

f. said arcuate curved central portion being a torsion element generally coaxially of the axis of the respective tubular hinge means and spaced outwardly thereof, said torsion element being deflected by contraction as the respective blades are moved to folded position whereby it produces a force in the spring means urging the pair of blades toward unfolded position.

8. A closure as set forth in claim 7 wherein:

a. said fingers of each spring having the portions thereof extending over said adjacent end edges of the hingedly interconnected blades in engagement of said end edges and cooperating to hold said blades against relative movement longitudinally of said tubular hinge means.

9. A closure as set forth in claim 8 wherein:

a. a said torsion spring means is provided for each end of the hinge connection for a pair of blades.

* * * * *